United States Patent [19]

Fusaroli

[11] 4,117,572

[45] Oct. 3, 1978

[54] DRAWING FRAME WITH A BELT CONTROL SYSTEM, FOR SPINNING FRAMES

[75] Inventor: Goffredo Fusaroli, Milan, Italy

[73] Assignee: S.A.M.P.R.E. S.p.A., Milan, Italy

[21] Appl. No.: 742,434

[22] Filed: Nov. 17, 1976

[30] Foreign Application Priority Data

Nov. 28, 1975 [IT] Italy ..... 29817 A/75

[51] Int. Cl.[2] ..... D01H 5/86

[52] U.S. Cl. ..... 19/244; 19/249

[58] Field of Search ..... 19/244–258, 19/236; 29/113 R

[56] References Cited

U.S. PATENT DOCUMENTS 2,862,250 12/1958 Fusaroli ..... 29/113 R X

FOREIGN PATENT DOCUMENTS 1,428,574 1/1966 France ..... 19/248

1,453,418 8/1966 France ..... 19/258

945,436 12/1963 United Kingdom ..... 19/244

*Primary Examiner*—Dorsey Newton

[57] ABSTRACT

In a drawing frame having a fibre-control system composed by two confrontingly and superposedly mounted closed-lap belts, the improvement consisting in that the upper-belt driving cylinder has a barrel-like sleeve of an elastomeric material of an appropriate hardness mounted thereon, so as to improve the fibre tow control and to adapt said cylinder to the processing requirements of tows or webs of variable bulk. It is preferred that the barrel-like sleeve is thinner at the middle section than at the end sections.

1 Claim, 6 Drawing Figures

DRAWING FRAME WITH A BELT CONTROL SYSTEM, FOR SPINNING FRAMES

This invention relates to drawing frames with a control system composed by belts as used in the spinning frames for natural and synthetic fibres.

It is known that these drawing frames mainly comprise a couple of rollers for feeding a web or a tow of fibres, a couple of drawing rollers and, arranged between these two couples of rollers, a fibre-control system active during the refining stage, which is composed, in the case in point, by two belts which are passed, each over a roller and a tightening member. In each of said set of roller or cylinders, the lower cylinder is driven, whereas the upper one is pressed against the lower cylinder in order to be driven to rotation.

The couple of drawing rollers is rotated at a speed which is faster than that of the feeding rollers and the ratio between said two speed is commonly called the drawing ratio and can be varied, consistently with the kind of fibres, for example from 5 to 50 and over. In the control system the two belts, between which the mass of fibres which compose the web being thinned, are pressed the one against the other by the associated set of rollers, of which the lower one is driven and the upper one is pressed, and thus dragged by the lower roller.

If the length of the fibres is less than the distance between the contact generating line of the set of cylinders on which the belts are passed and the generating contact line of the set of drawing or outlet cylinders, the upper cylinder on which the upper belt is wrapped for about one half of the cylinder periphery, can have a rectilinear surface, whereas it must offer a central peripheral zone which is depressed relative to the lateral zones whenever the fibres are longer than the distance aforementioned so as to allow only those fibres to slide, which are progressively pinched by the couple of the output cylinders, the other fibres, which have not yet been caught or pinched, being conversely retained. As a matter of fact, the fibres as pinched by the couple of the outlet cylinder must slide at a speed which is as many times a multiple of the speed of the other fibres, as the magnitude of the drawing ratio is, in order that the tow may be thinned out.

The central depression or cavity in the upper cylinder over which the upper belt is wrapped over about one half of the periphery, must have a depth which is a function of the mass or volume of the fibres which make up the web, just to allow the pinched fibres to slide and to retain the non-pinched ones.

This requirement imposes a frequent replacement of the upper cylinder by other cylinders which have a depth of the central depression which is adequate to the volume of the tow being processed.

As a matter of fact, when a belt of an elastomeric material, with or without a textile insert, is wound halfway about the periphery of a cylinder on which is rests only along its marginal edges on the two laterally spaced ends of the cylinder, it is depressed at the centre in a manner which is the more intensive as greater is the distance between the lateral ends of the cylinder which support the edges of the belt. As a result, in correspondence with the depression, the upper belt does not contact the lower belt, but an empty space is caused in correspondence with the area of passage of the mass of fibres to be controlled. Hence, the necessity arises of having a number of cylinders available, which have different depths of the depressed central zone, in order to reduce the depression of the belt and to prevent the depression from being deeper than is required by the mass of fibres to be controlled when there are few fibres, or to prevent it from being shallower than is required when there are many fibres.

An object of the present invention is thus to do away with the drawbacks illustrated above by providing a drawing frame with a belt control system equipped with a cylinder for the upper belt which does not require to be replaced consistently with the volume of fibres to be processed, while concurrently ensuring the sliding of the fibres pinched by the couple of the output cylinders and the retainment of the not yet pinched fibres with an efficient control also of the fibres scattered at the edges of the tow and the achievement of thickening effect of the latter.

According to the invention, this object is achieved with a cylinder for the upper belt which comprises a central axle and at least a bushing which is mounted for rotation thereon, said bushing having lateral edges which radially project relative to a depressed central area, characterized in that the depressed central zone of the bushing is surrounded by a hollow sleeve of an elastomeric material shaped in a barrel-like configuration with the diameter at the centre longer than the diameter at the lateral edges of the bushing.

The barrel-like sleeve can be inserted between the two lateral edges, or can it be slipped with its borders on the side borders of the bushing.

The borders of the barrel-like sleeve of an elastomeric material have preferably a greater thickness than that of the central bulging portion and all the sleeve is formed by the same continuous elastomeric material, closed in a tubular manner.

By virtue of such a barrel-like sleeve, the upper belt which wrapped around one half of the periphery of the sleeve is resiliently pushed outwards and its spontaneous central depression in the wrapped portion is prevented. As a result, the upper belt is kept pressed gently against the lower belt, a self-acting reaction being thus originated against any fibre mass passed between the two belts, without any necessity for the upper belt to find a reaction force in the bottom of the depressed central portion of the bushing, contrary to what commonly occurs in the systems known heretofore. On the other hand, the upper belt can automatically be lifted by that span which is required by the volume of the fibres passed between the two belts. Stated another way, the barrel sleeve acts like a variable-diameter bottom, that which permits a single cylinder to be used, without any necessity for replacements, irrespective of the volume of fibres which make up the tow being processed.

Additional features and advantages of the present invention will become clearly apparent and in more detail from the ensuing description of a few exemplary embodiments thereof as illustrated in the accompanying drawings, wherein:

FIG. 1 diagrammatically shows the drawing frame with belts.

Figure 1:
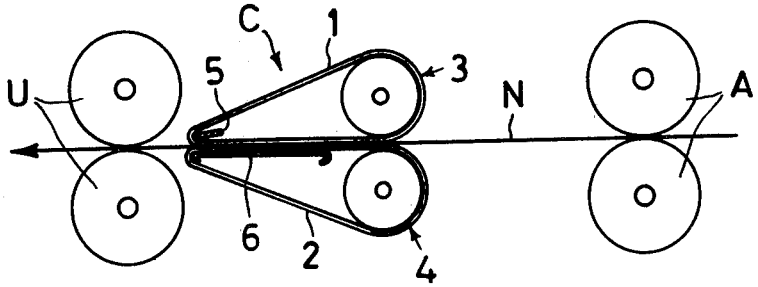

As is diagrammatically shown in FIG. 1, the drawing frame generally comprises a couple of feeding cylinders, indicated at A, a couple of drawing or output cylinders, indicated at U, and, arranged between said two couples of cylinders, a belt control system, generally indicated at C. Between the two cylinders which make up each of said couples, and between the two belts of the control system, the tow N of the fibres being processed is passed so as to undergo the expected thinning.

The invention relates to the belt control system as better illustrated in the following FIGURES of the drawings.

The control system C comprises an upper belt 1 and a lower belt 2, which, along a certain section, slide parallely to receive, therebetween along this section, the fibre tow being processed.

Figure 2:
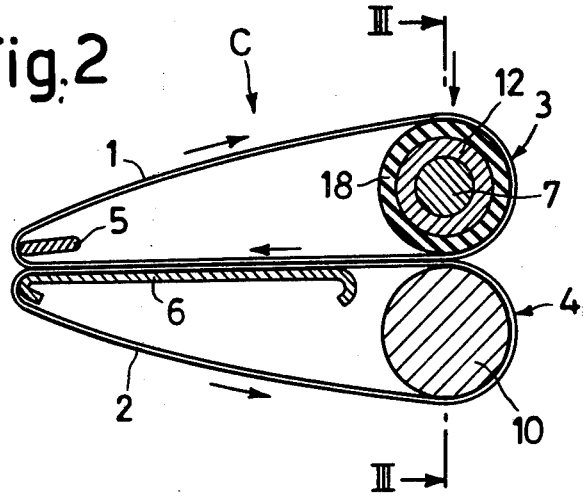
FIG. 2 is a longitudinal cross-sectional view of the belt-control system of the drawing frame, on an enlarged scale.

The upper belt 1 is wrapped around roughly one half of the peripheral surface of an upper cylinder 3 and is then passed over a tightening member 5, whereas the lower belt 2 is wrapped around roughly one half of the periphery of a lower cylinder 4 and rests with its section parallel to a section of the upper belt 1, on a bridge 6. The lower cylinder 4 is driven (by means not shown) to be rotated in the direction of the arrow indicated in FIG. 2.

The upper cylinder 3 is pressed against the lower cylinder 4 (see the arrows in FIGS. 2, 3 and 5) with a preselected force so as to ensure its driving along with that of the belts passed between the two cylinders.

In the exemplary embodiments as shown in FIGURES from 3 to 5, there are provided couples of double cylinders with two couples of double cylinders with two couples of belts but, inasmuch as the concepts of the invention can indifferently be applied to couples of single and double cylinders, the ensuing description will prevailingly be referred to one half only of said couple of double cylinders.

The lower cylinder 4 (see FIGS. 3 and 4) has an axle 8 with a knurled portion 10 with a slightly enlarged diameter, on which the lower belt 2 is wrapped around on half of the periphery.

The upper cylinder 3, in its turn, is composed by an axle 7 on which is mounted, preferably by roller bearings so as to reduce friction (known per se and not shown), a bushing 9. The bushing 9 has two lateral edges 11 with knurled surfaces which have the function, under the pressure impressed in the direction of the arrow (see particularly FIG. 3), of the ensuring the rotational drive of the bushing and of the two belts 1 and 2 by the agency of the lower cylinder 4.

Between the lateral borders 11 and adjacent thereto there are two cylindrical zones 12, 13 having a diameter shorter than the diameters of the lateral borders, and, between said two cylindrical zones, the bushing has a central depressed zone 14, the diameter of which is shorter than the diameter of the zones 12, 13, which are appropriately radiussed to the cylindrical zones aforementioned.

Figure 6:
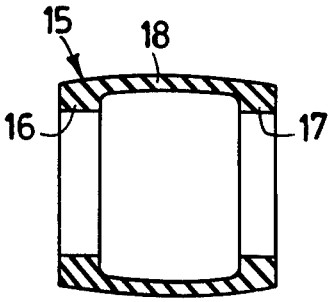
FIG. 6 is an axial cross-sectional view of the barrel sleeve only.

Between the two lateral edges 11 of the bushing 9 is inserted a sleeve 15 in the form of a barrel, of an elastomeric material, (see also FIG. 6), which has thickened borders 16, 17 and a central barrel-like crowned zone 18 with a reduced thickness. The borders 16, 17 of the barrel sleeve 15 rest against the cylindrical zones 12, 13 of the bushing 9 and are retained axially by the lateral edges 11 of the bushing.

Under the unloaded condition (see the left portion of FIG. 3) the edges 16, 17 of the sleeve 15 are flush with the lateral borders 11 of the bushing 9, whereas the central crowned portion of the sleeve protrudes, so that the belt 1 which wraps the barrel sleeve 15 is resiliently urged outwards and in any case a central depression thereof is prevented.

Figure 3:
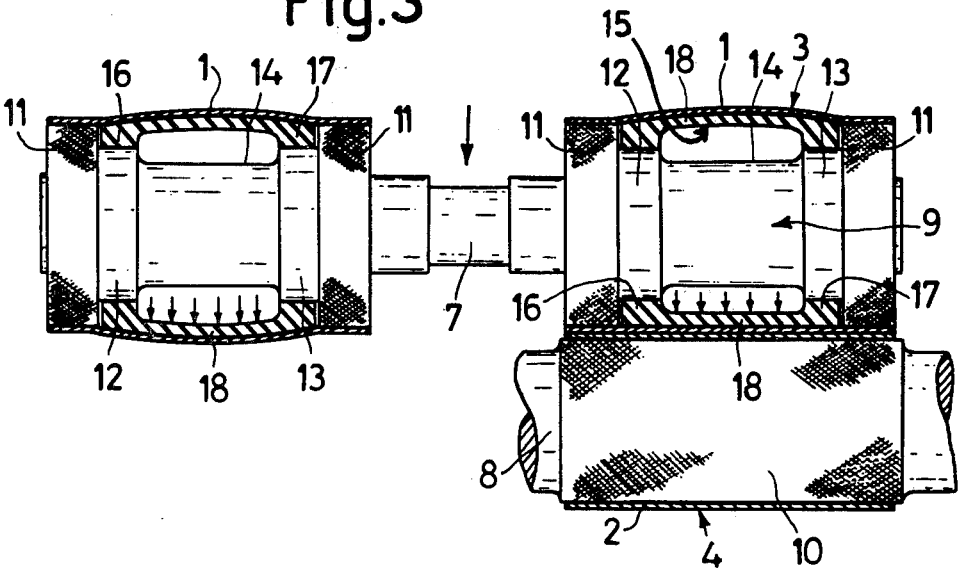
FIG. 3 is a cross-sectional view taken along the line III—III of FIG. 2 through a couple of double cylinders for two couples of belts, in which the left portion of the lower cylinder has been cutaway.
Figure 4:
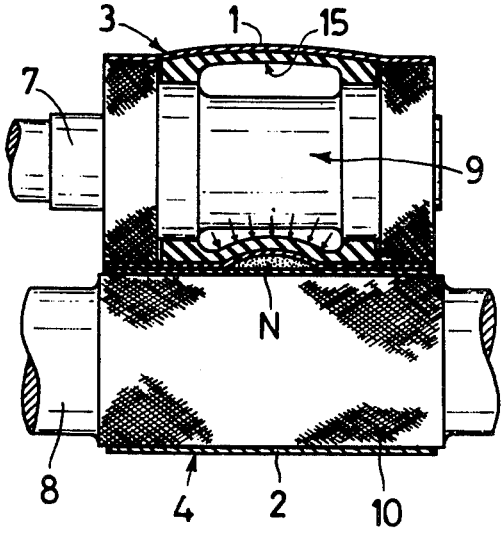
FIG. 4 shows a cross-sectional view, similar to FIG. 3, of the right portion only of the couple of cylinders with a fibre tow inserted between the two belts.

In the active position, that is, when the upper cylinder 3 is pressed against the lower cylinder 4, the central crowned portion 18 of the sleeve 15 gently presses the upper belt 1 against the lower belt 2, as indicated by the arrows in the right portion of FIG. 3, ensuring the contact between the two belts along their entire length throughout.

When the fibre tow N being thinned is passed between the two belts (see FIG. 4), the upper belt 1 can automatically be lifted by that distance as is required by the volume of the fibres. By so doing, it is ensured, on the one side, that the fibres pinched by the couple of the output cylinder U of the drawing frame can slide and, on the other side, that the not yet pinched fibres are retained. In addition, since the reaction force of the barrel sleeve 15 is directed vertically relative to the several points of deformations (see the arrow in FIG. 4), also the fibres scattered at the edges of the tow N are efficiently controlled and a thickening effect is obtained on the mass of the tow fibres.

Of course, the depth of the depression or hollowing-out of the central portion 14 of the bushing 9 must be the maximum possible to permit the lifting of the upper belt 1 and the deformation of the central crowned portion 18 of the sleeve 15 to a degree which corresponds to the volume of the fibres which make up the several tows to be processed, irrespective of the fact that small or great volumes are involved. In general, this depression of the central part of the bushing is the maximum which is permissible consistently with the internal dimensions of the bushing as such, on taking into account the bulk of the rolling bearings by which the bushing is mounted on the axle 7.

It should be noted, moreover, that the elastomeric material of which the sleeve 15 is made, should be of a preselected hardness so as to provide the outward thrust and to permit the inward radial deformation.

Figure 5:
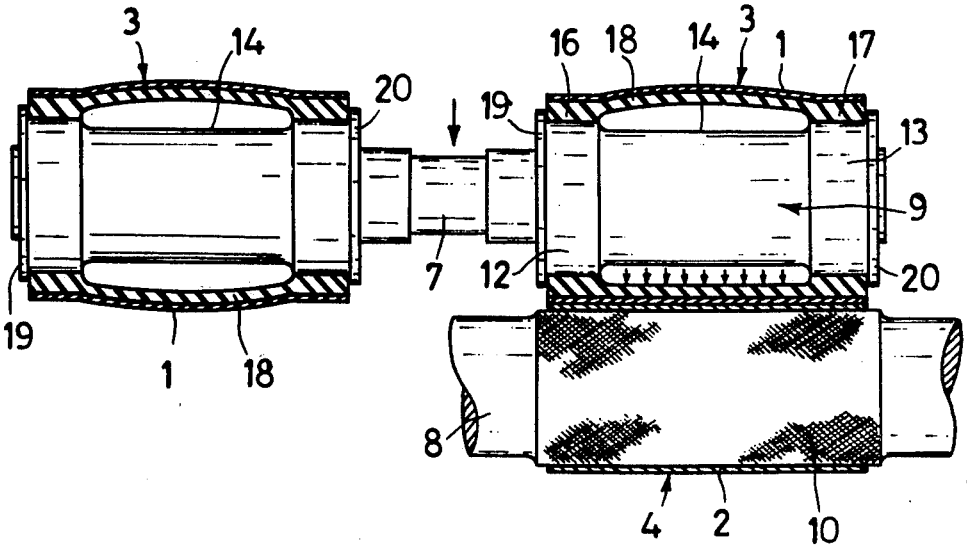
FIG. 5 is a cross-sectional view similar to FIG. 3 through a couple of double cylinders, according to an alternative embodiment.

Considering now the alternative embodiment shown in FIG. 5, in which equal parts are indicated by equal reference numerals as in the previous FIGURES, it can be seen that the only difference virtually consists in the fact that the bushing 9 has no knurled lateral borders. The barrel sleeve 15 is slipped onto the bushing 9 with its enlarged borders 16, 17 resting on the cylindrical zones 12, 13 of the bushing and axially retained by flanges 19, 20 of the rotary bushing. The sleeve 15 has the same width as the belt 1 which is wrapped around it. By the pressure impressed on the upper cylinder in the direction of the arrow of FIG. 5, the borders 16, 17 of the sleeve 15 are pressed against the lower cylinder (with the two belts 1 interposed therebetween) and ensure the rotation of the bushing 9 and the drive of the belts without damaging the latter in the zones subjected to an intense pressure.

It is to be noted, furthermore, that in the case of couples of twin-cylinders, as shown in the drawing, the force which presses the upper cylinder against the lower one is applied at the centre (as shown by the arrows of FIGS. 3 and 5), whereas in the case of couples of single cylinders, the central axle which carries the rotary bushing of the upper cylinder must be a through-bushing, in the conventional way, and the pressure is exerted at both ends of the axle.

What we claim is:

1. A drawing frame with a belt control system for spinning frames comprising a couple of feeding cylinders, a couple of drawing cylinders and, arranged between said couples of cylinders, a control system composed of two superposed belts each passed over one of a pair of further, vertically spaced cylinders and an associated tightening member, the cylinder for the upper belt comprising a central axle, at least one rotary bushing mounted on said axle, said bushing being pressed downwardly toward the lower, driving cylinder of said pair, and having thereon a pair of laterally spaced, circumferential shoulders of equal diameter projecting radially outwardly and coaxially relative to a central depressed zone thereof, and a hollow sleeve of an elastomeric material mounted on said bushing and surrounding the depressed area thereof and having a barrel-like shape and an axial bore with a diameter at its centre which is greater than the diameter of said bore at the ends of the sleeve, whereby said sleeve has enlarged borders of similar configuration at opposite ends thereof, said barrel-shaped sleeve being mounted between, and laterally retained by, the two shoulders of the bushing and having its enlarged borders seated on spaced, cylindrical zones of equal diameter formed on said bushing adjacent to said shoulders, the depressed central zone of the bushing being located between said cylindrical zones, and the diameters of said zones being smaller that the diameter of said shoulders, and the thickness of said borders of the barrel-shaped sleeve being substantially equal to the diameter differential between said cylindrical zones and said shoulders of said bushing, whereby said shoulders on said bushing are maintained in drive transmitting relationship with said lower, driving cylinder of said pair, and said shoulders on said bushing operatively clamping said borders against lateral expansion on said cylindrical zones, whereby during use passage of a fiber tow between said pair of cylinders will cause said sleeve to curve inwardly only at its central portion into said depressed zone of said bushing.

* * * * *